US005235790A

United States Patent [19]

Ishikawa et al.

[11] Patent Number: 5,235,790

[45] Date of Patent: Aug. 17, 1993

[54] ARRANGEMENT FOR ATTACHING WINDOW BOARD TO TRANSOM

[75] Inventors: Masayoshi Ishikawa; Shinji Tanikawa, both of Toyama, Japan

[73] Assignee: Yoshida Kogyo K.K., Tokyo, Japan

[21] Appl. No.: 754,178

[22] Filed: Aug. 27, 1991

Related U.S. Application Data

[63] Continuation of Ser. No. 494,819, Mar. 15, 1990, abandoned, which is a continuation of Ser. No. 300,948, Jan. 24, 1989, abandoned.

[30] Foreign Application Priority Data

Feb. 4, 1988 [JP] Japan ..... 63-12997

[51] Int. Cl.[5] ..... E04B 2/28

[52] U.S. Cl. ..... 52/235

[58] Field of Search ..... 52/235, 238.1, 242, 52/205, 710, 711, 243, 398, 400, 403

[56] References Cited

U.S. PATENT DOCUMENTS

| | | | |
|---|---|---|---|
| 2,676,680 | 4/1954 | Kindorf | 52/710 |
| 2,784,812 | 3/1957 | Kindorf | 52/710 |
| 3,553,918 | 1/1971 | Dauson | 52/235 |
| 3,734,550 | 5/1973 | Vance | 52/235 |
| 3,968,608 | 7/1976 | Swango | 52/235 |
| 4,130,977 | 12/1978 | Taylor, Jr. et al. | 52/710 |
| 4,194,333 | 3/1980 | Paton et al. | 52/710 |
| 4,799,344 | 1/1989 | Francis | 52/235 |

FOREIGN PATENT DOCUMENTS 56-48861 11/1981 Japan .

*Primary Examiner*—David A. Scherbel
*Assistant Examiner*—Michele A. Van Patten
*Attorney, Agent, or Firm*—Hill, Van Santen, Steadman & Simpson

[57] ABSTRACT

An arrangement for attaching a window board to a transom which comprises a transom having at least one groove formed in the inner end face thereof so as to open towards the indoor side; a horizontally extending cover attachment to which the window board is attached, the cover attachment extending in parallel to the transom; and a plurality of connecting members adapted to be engaged within said groove so as to fixedly secure the cover attachment to the inner end face of the transom. Between the inner end face of the transom and the cover attachment, a heat insulation material is interposed.

5 Claims, 5 Drawing Sheets

1
10
13
13b
13a
41
48
40
47
45
46
44
42
50
51
52
53
54
55
56
57
58

ARRANGEMENT FOR ATTACHING WINDOW BOARD TO TRANSOM

This is a continuation of application Ser. No. 494,819 filed Mar. 15, 1990, now abandoned which is a continuation of Ser. No. 300,948, filed Jan. 24, 1989, now abandoned.

BACKGROUND OF THE INVENTION

1. Field of the Invention

This invention relates to an arrangement for attaching a window board to a transom constituting a window portion in a curtain wall.

2. Description of the Prior Art

In the window portion in the prior art curtain wall comprised of rectangular frames formed by the left and right mullions and upper and lower transoms, and panel members mounted thereon, a window board is connected to the indoor side of the transom by means of screws.

In such a prior art arrangement for attaching a window board to a transom, the metallic transom is kept in contact with the metallic window board, and the transom is exposed to the outside air, and therefore the outside air is allowed to pass through the transom to the window board so that the difference in temperature between the outside air and the indoor air tends to cause dew condensation on the window board. When dew condensation occurs on the window board, there is tendency of condensate or water droplets flowing thereon in the room, which is quite objectionable.

Further, since the window board is connected to the transom by means of screws, the window board connecting operation per se becomes very troublesome.

SUMMARY OF THE INVENTION

The present invention has been contemplated in view of the above-mentioned circumstances in the prior art, and has for its object to provide an arrangement for attaching a window board to a transom which enables the attaching operation to be carried out simply and without causing dew condensation.

In order to achieve the above-mentioned object, according to the first aspect of the present invention, there is provided an arrangement for attaching a window board to a transom which comprises a transom having at least one groove formed in the inner end face thereof so as to open towards the indoor side; a horizontally extending cover attachment to which the window board is attached, the cover attachment extending in parallel to the transom; and a plurality of connecting members adapted to be engaged within said groove so as to fixedly secure the cover attachment to the inner end face of the transom.

In order to achieve the above-mentioned object, according to the second aspect of the present invention, there is provided an arrangement for attaching a window-board to a transom which comprises a transom having at least one groove formed in the inner end face thereof so as to open towards the indoor side; a horizontally extending cover attachment having a horizontal support piece formed integrally with the body thereof, the cover attachment being disposed on the inner side of and in parallel with the transom; a plurality of connecting members each being adapted to be attached to the cover attachment so as to project therethrough horizontally from the indoor side to the outdoor side of the cover attachment, each connecting member having an engaging portion formed integrally therewith and adapted to be engaged within the groove formed in the transom so as to fixedly secure the cover attachment by the interposition of a heat insulation material to the inner end face of the transom; and a window board having a receiving piece formed integrally formed therewith so as to be engaged with the horizontal support piece of the cover attachment, the window board being adapted to be supported by and connected to the cover attachment by engaging the receiving piece with the horizontal support piece of the cover attachment.

According to the third aspect of the present invention, there is provided an arrangement for attaching a window board to a transom, characterized in that each of the connecting members as set forth in any one of the first and the second aspects has a flange portion, a knob portion projecting on one side from the one end face of the flange portion, a circular projection projecting on the other side from the other end face of the flange portion, a small diameter shaft portion formed integrally with the circular projection so as to project from the end face of the circular projection, and an engaging portion formed integrally with the leading end of the small diameter shaft portion, the engaging portion being formed in a plate member having opposite sides which are shorter than the width of a narrow opening of the groove formed in the transom and other opposite sides whose length is substantially equal to the width of an enlarged groove portion of the groove.

According to the forth aspect of the present invention, there is provided an arrangement for attaching a window board to a transom, characterized in that the transom has an inner longitudinal plate formed integrally therewith so as to project upwardly on the indoor side, and an uprising piece formed integrally therewith so as to project upwardly and in parallel with the inner longitudinal plate at a position where is spaced inwardly away from the inner longitudinal plate, whereby forming a trough-shaped portion having an upward opening between the uprising piece and the inner longitudinal plate.

The above and other objects, features and advantages of the present invention will become apparent to those skilled in the art from the following detailed description made with reference to the accompanying drawings in which preferred embodiments incorporating the principles of the present invention are shown by way of example only.

DETAILED DESCRIPTION OF PREFERRED EMBODIMENTS

The present invention will now be described by way of example only wiht reference to the accompanying drawings.

Figure 1:
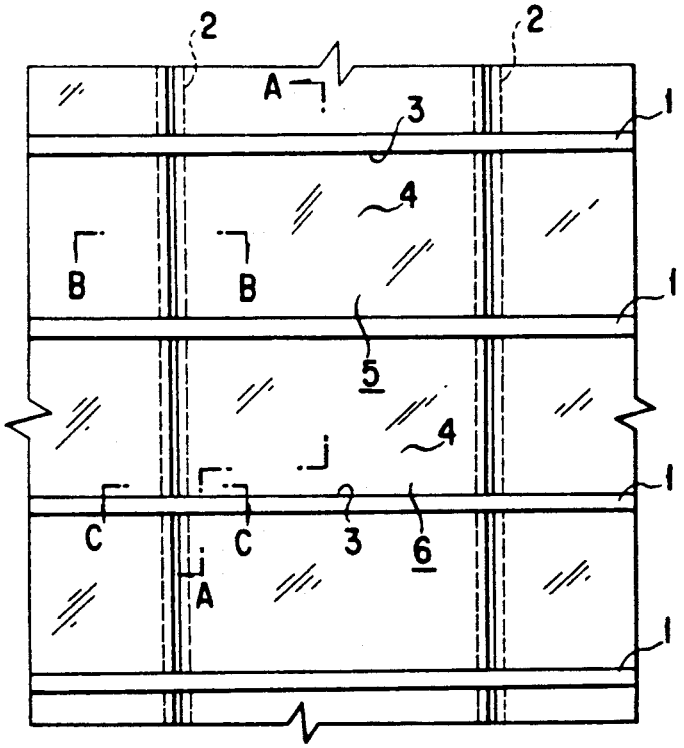
FIG. 1 is a schematic, front view of a fabricated curtain wall.

A fabricated curtain wall comprises, as shown in FIG. 1, comprises a plurality of rectangular frames 3 formed by a plurality of horizontally extending transoms 1 connected to a building body, not shown and a plurality of vertically extending mullions 2 attached to the transoms 1, and panel members 4 mounted on the respective rectangular frames 3, thereby forming window portions 5 and a spandrel portions 6. The panel member 4 in the window portions 5 are made of double glazing whilst those in the spandrel portions 6 are made of glass.

Figure 2:
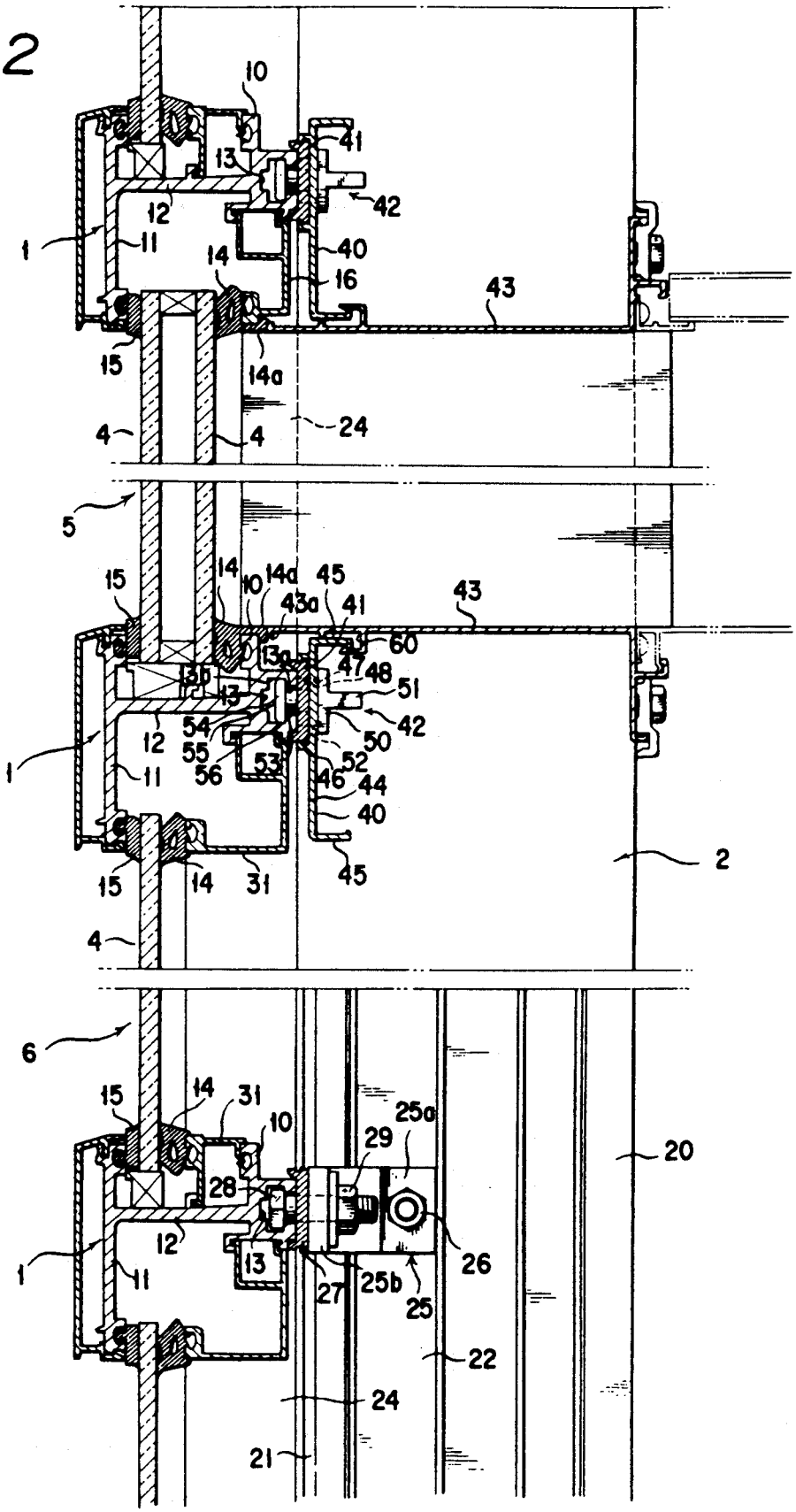
FIGS. 2, 3 and 4 are schematic, sectional views of one embodiment of the present invention taken along lines A—A, B—B and C—C, respectively, in FIG. 1.

Each of the above-mentioned transoms 1 is a long member having a substantially H-shaped section as shown in FIG. 2, which is formed by an inner longitudinal plate 10 and an outer longitudinal plate 11 which are connected by a transverse plate 12 at their approximately intermediate parts. The inner longitudinal plate 10 has a longitudinally extending groove 13 formed therein so as to open horizontally on the indoor side, and upper and lower parts of the panel member 4 are mounted between the inner longitudinal plate 10 and the outer longitudinal plate 11 through inner transverse gaskets 14 and outer transverse gaskets 15. The inner transverse gasket 14 in the window portion 5 has an extension piece 14*a* projecting therefrom towards the inner longitudinal plate 10 and a batten 16. The above-mentioned groove 13 has a substantially U-shaped section which is formed by an opening 13*a* having a small width and a groove portion 13*b* having a large width.

Figure 3:
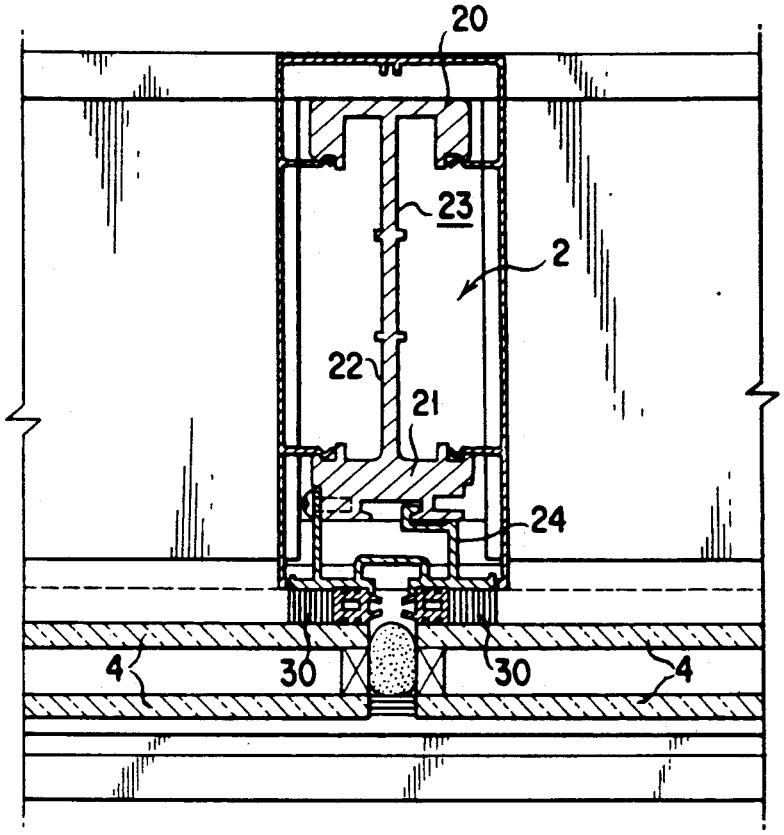
Figure 4:
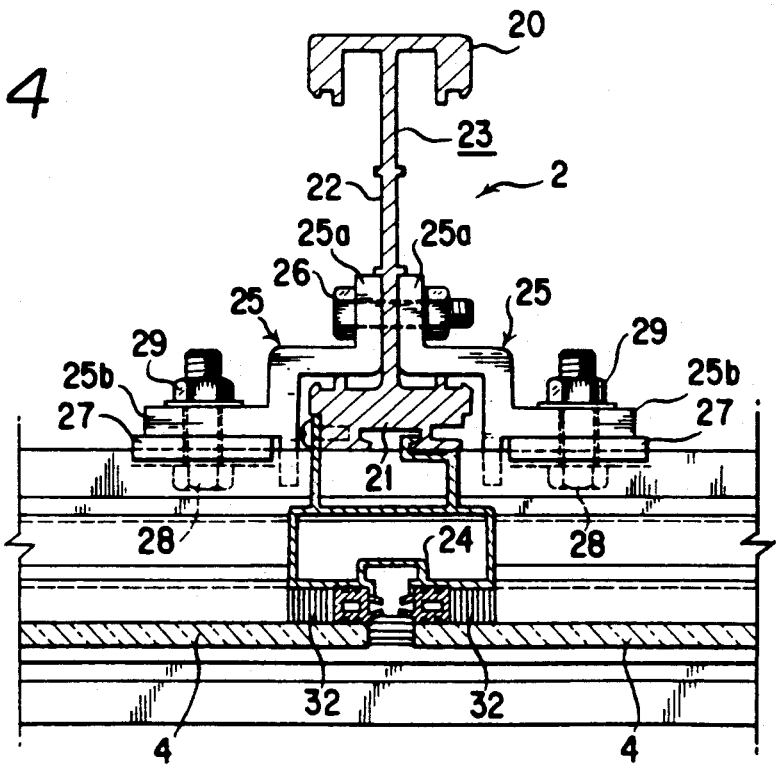

The above-mentioned mullion 2 comprises, as shown in FIGS. 3 and 4, a mullion body 23 having a substantially H-shaped section which is formed by an inner base piece 20 and an outer attachment piece 21 connected by a connecting piece 22 fomred integrally therewith, and a mullion attachment 24 fixedly secured to the mullion body 23 by means of screws. The mullion body 23 in the spandrel portion 6 is connected to the indoor side of the transom 1 by means of a pair of metal connecting fixtures 25, 25.

Stating in concrete manner, as shown in FIGS. 2 and 4, an attachment piece 25*a* of the metal connecting fixture 25, which is formed on one side thereof, is connected to the connecting piece 22 of the mullion body 23 by means of a bolt 26, whilst another attachment piece 25*b* of the fixture 25, which is formed on the other side thereof, is connected through a heat insulation material 27 to the inner longitudinal plate 10 of the transom 1 by means of a bolt 28 fitted in the groove 13 and a nut 29 so as to prevent the outside air from passing through the transom 1 to the mullion body 23.

As shown in FIG. 2, the rectangular attachment 24 located in the above-mentioned window portion 5 is flush with the inner longitudinal plate 10 of the transom 1 towards the outdoor side, and as shown in FIG. 3, the longitudinal portion of the panel member 4 is adhesively bonded to the external surface of the rectangular attachment 24 by means of adhesive sealing members 30 so that the mullion 2 can be covered with the panel member 4. Whilst, the rectangular attachment 24 located in the above-mentioned spandrel portion 6 is, as shown in FIG. 2, flush with a batten 21 of the transom 1, and the longitudinal portion of the panel member 4 is fixedly secured or ahesively bonded to the external surface of the rectangular attachment 24 by means of adhesive sealing members 32 so that the mullion 2 can be covered with the panel member 4.

A cover attachment 40 is connected through a heat insulation material 41 to the inner longitudinal plate 10 of the transom 1 forming the above-mentioned window portion 5 by means of a connecting member 42. A window board 43 is engaged or connected with the cover attachment 40.

The above-mentioned attachment cover 40 has horizontal support pieces 45 which are formed integrally with the upper and lower parts of the longitudinal plate 44 and which extend towards the indoor side. The longitudinal plate 44 has a recess 46 formed on the outer side thereof for mounting a heat insulation material, i.e., a heat insulation material 41 is fitted in the recess 46. The length of the cover attachment 40 and the heat insulation material 41 can be set as desired. The above-mentioned longitudinal plate 44 and the heat insulation material 41 are formed with through-holes 47 and 48, respectively.

Figures 5, 6:
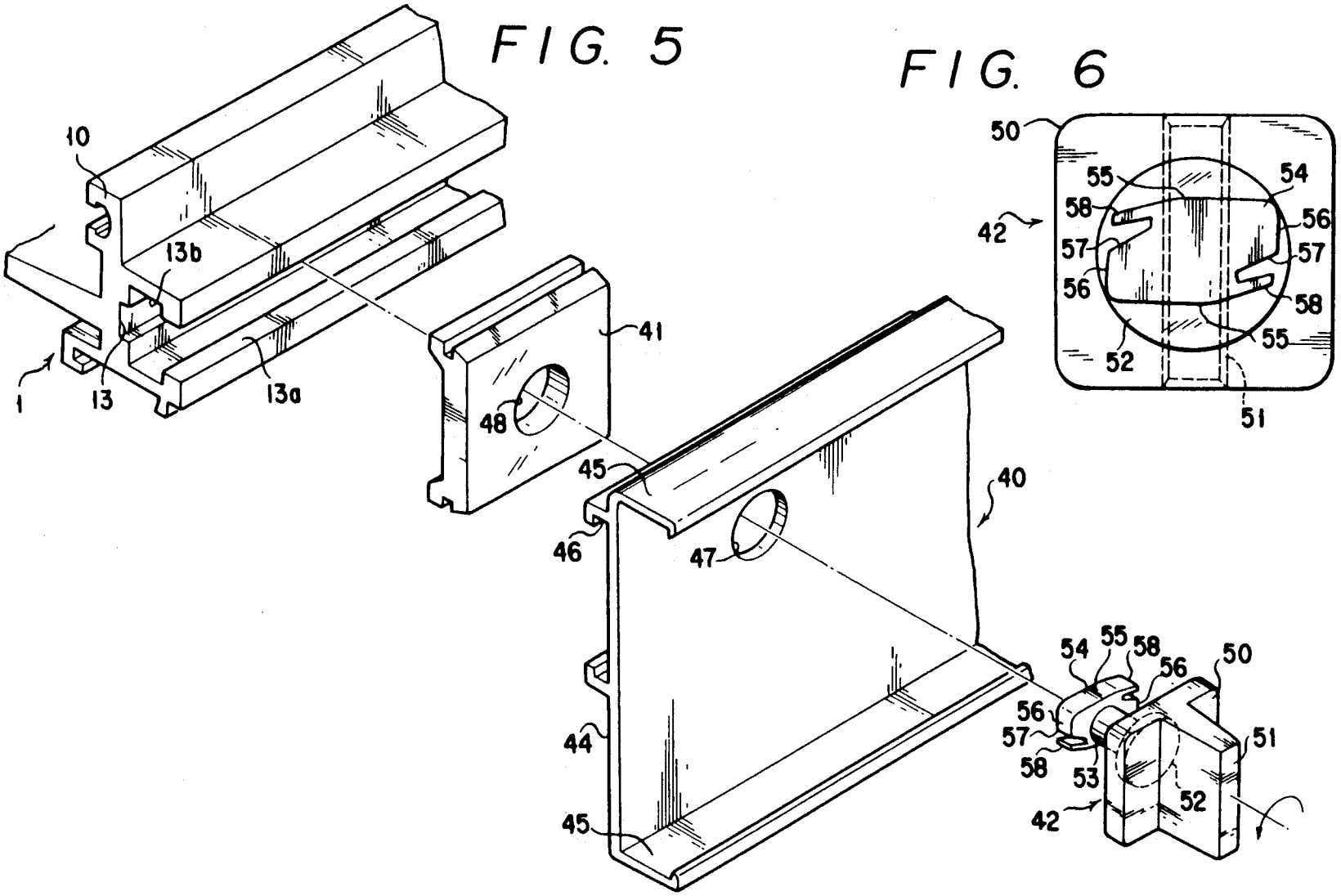
FIG. 5 is a schematic, exploded, perspective view of a connecting portion of a cover attachment to a transom.
FIG. 6 is a schematic, front view of a connecting member.

As shown in FIGS. 2 and 5, the above-mentioned connecting member 42 comprises a rectangular, plate-shaped flange portion 50 formed at one end thereof, a knob portion 51 formed integrally with the flange portion at the inner end face thereof, a circular projection 52 formed integrally with the flange portion 51 at the outer end face thereof, and a small diameter shaft portion 53 formed integrally with the circular projection 52 at the centre of the outer end face thereof so as to extend therefrom, the shaft portion 53 having an engaging portion 54 formed integrally therewith at the outer leading end thereof.

The above-mentioned circular projection 52 is of the size adapted to fit in the through holes 47 and 48 formed in the above-mentioned longitudinal plate 44 and heat insulation material 41, respectively, whilst the shaft portion 53 is of such a size as to be inserted and rotated in the opening 13*a* of the above-mentioned groove 13. As shown in FIGS. 5 and 6, the above-mentioned engaging portion 54 is a plate-shaped member having a substantially rectangular longitudinal section. The thickness of the engaging portion 54 is smaller than the depth of the groove portion 13*b* of the groove 13 formed in the transom 1. The length of the engaging portion 54 between the opposite sides 55, 55 on one side thereof is somewhat smaller than the width of the opening 13*a* of the groove 13, whilst the length of the engaging portion 54 between the opposite sides 56, 56 on the other side thereof is substantially equal to the width of the groove 13*b* in the groove 13. The corner portions of the engaging portion 54 are cut away as shown by reference numerals 57, 57 thereby forming spring pieces 58, 58. The engaging portion 54 is formed as being somewhat smaller in size than the above-mentioned circular projection 52 so that it can pass through the through-holes 47 and 48, respectively. After the heat insulation material 41 has been fitted in the cover attachment 40, the connecting member 42 is fitted to the cover attachment 40 by inserting the engaging member 54 of the connecting member 42 through the through-holes 47 and 48 to such an extent that the circular projection 52 may be fitted rotatably and tightly in the through-hole 47. Then, in this condition, the connecting member 42 is turned until the opposite sides 55, 55 of the engaging portion 54 on one side thereof assume vertically upper and lower positions. Thereafter, the engaging portion 54 is inserted through the opening 13*a* of the groove 13 into the groove portion 13*b*, and then the connecting member 42 is turned manually by means of the knob portion 51 by 90 degrees in the direction shown by the arrow until the opposite sides 56, 56 of the engaging portion 54 on the other side thereof may be urged against the inner, upper and lower surfaces of the groove 13*b* thereby connecting the cover attachment 40 through the heat insulation material 41 to the inner longitudinal plate 10 of the transom 1.

Further, since when turning the connecting member 42 the spring pieces 58, 58 formed in the corner portions of the engaging portion 54 are readily subjected to elastic deformation, the engaging portion 54 can be turned smoothly, and when it has been turned by 90 degrees the spring pieces 58, 58 will be returned resiliently to their original state with the result that it become difficult to disengage the engaging portion 54 from the groove portion 13*b*.

Further, since the circular projection 52 of the connecting member 42 is tightly fitted in the throughhole 47 formed in the longitudinal plate 44 of the cover attachment 40, the possible transverse or leftward and rightward idle play of the cover attachment 40 can be eliminated.

As shown in FIG. 2, the above-mentioned window board 43 is formed with a receiving piece 60 adapted to be engaged with the horizontal support piece 45 of the above-mentioned cover attachment 40. After the cover attachment 40 has been connected to the transom 1 as aforementioned, the receiving piece 60 of the window board 43 is engaged with the horizontal support piece 45.

At that time, the outer end 43*a* of the window board 43 is brought into contact with an extension piece 14*a* of the inner transverse gasket 14.

Further, in the above-mentioned embodiment, the heat insulation material 41 is attached to the cover attachment 40 in the longitudinal direction, however, a plurality of short heat insulation material 41 may be attached to the cover attachment 40 at intervals of some distance. In the latter case, the connecting member 42 can be attached between the adjoining segments of the heat insulation material, and therefore it becomes unnecessary to let the connecting member 42 pass through the heat insulation material 41.

Figure 7:
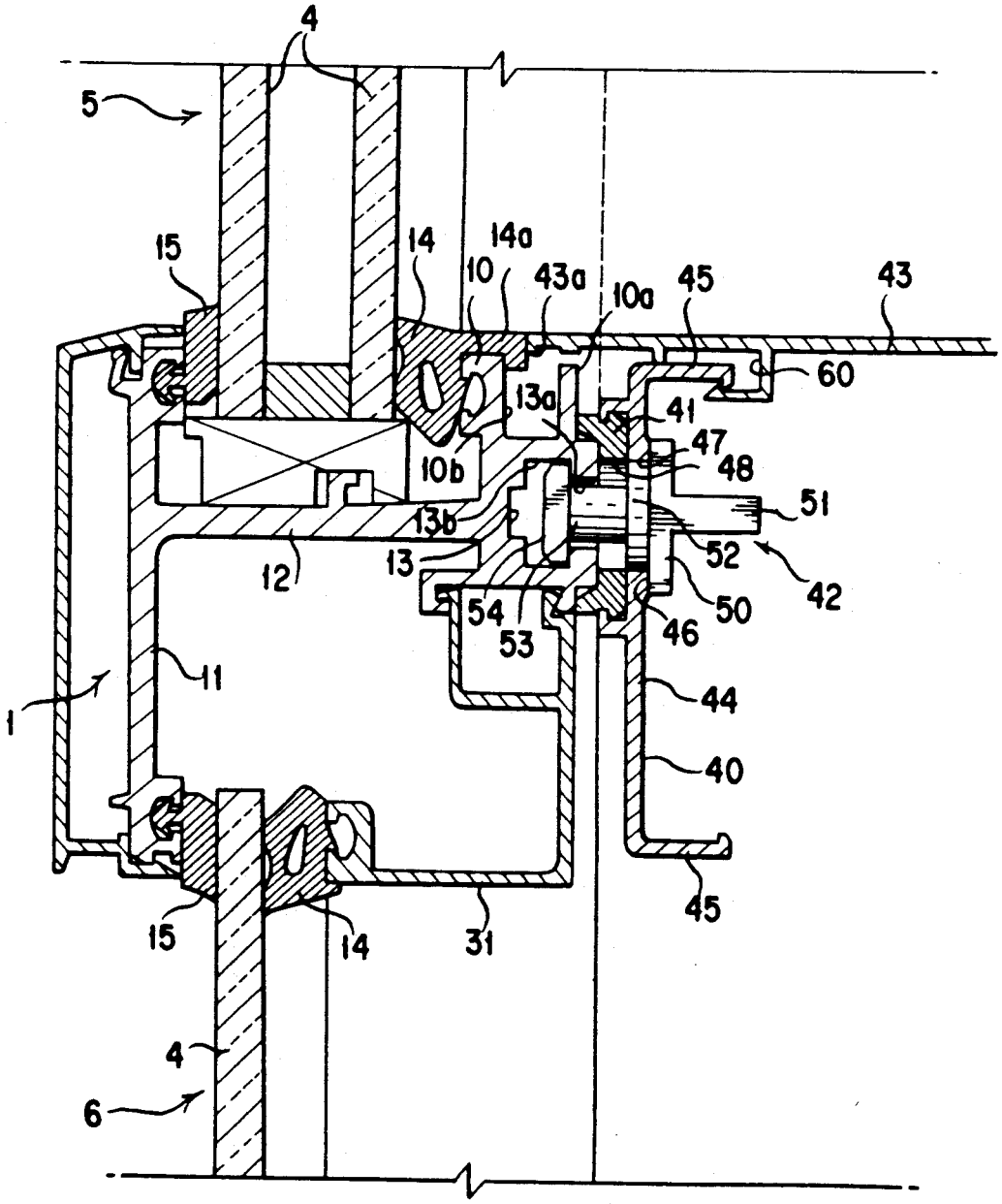
FIG. 7 is a schematic, fragmentary, longitudinal sectional view of another embodiment of the present invention.

Further, it is possible to form an uprising piece 10*a* integrally with the inner longitudinal plate 10 on the indoor side of the transom 1 thereby forming an upwardly open trough shaped portion 10*b* as shown in FIG. 7. By so doing, since the rainwater entering through the abutting portions of the extension piece 14*a* of the inner transverse gasket 14 and the window board 43 is collected in the trough portion 10*b* and does not flow down to the heat insulation material 41, there is no possibility of the heat insulation material 41 getting wet with rainwater or being frozen by the freezing of rainwater, etc., soaking it, thus enhancing the durability of the heat insulation material 41.

As described in detail hereinabove, according to the arrangement for attaching a window board to a transom according to the present invention, since the cover attachment 40 is connected through the heat insulation material 41 to the indoor side of the transom 1 and the cover attachment 40 is connected to the window board 43, the outside air passing into the transom 1 is prevented from reaching the cover attachment 40 and the window board 43 thus eliminating the possibility of dew condensation.

Further, since the cover attachment 40 can be attached to the transom 1 by engaging the engaging portion 54 of the connecting member 42 with the groove 13 of the transom 1, and the window board 43 can be connected to the transom 1 by engaging the receiving piece 60 with the horizontal support piece 45, the attachment of the window board 43 to the transom 1 can be made easily.

Further, according to the arrangement for attaching a window board to a transom according to the present invention, the cover attachment 40 can be connected simply to the transom 1 by inserting the engaging portion 54 through the opening 13*a* of the groove 13 into the groove portion 13*b* when the circular projection 52 of the connecting member 42 is rotatably fitted in the throughhole 47 of the cover attachment 40, and then turning manually the connecting member 42 by 90 degrees by means of the knob portion 51 to thereby engage the engaging portion 54 with the groove portion 13*b*, and further the leftward and rightward play of the cover attachment 40 can be prevented by the tight fitting of the circular projection 52 in the through-hole 47.

It is to be understood that the foregoing description is merely illustrative of preferred embodiments of the invention, and that the scope of the invention is not to be limited thereto, but is to be determined by the scope of the appended claims.

What is claimed is:

1. An arrangement for attaching a window board to a transom which comprises a generally horizontal transom having at least one groove formed in an inner end face thereof so as to open towards an indoor side of said transom; a horizontally extending cover attachment to which the window board is attached, the cover attachment extending in parallel to the transom; and a plurality of connecting members adapted to be engaged within said groove so as to fixedly secure the cover attachment to the inner end face of the transom wherein each of said connecting members has a flange portion, a knob portion projecting on a first side from a first end face of the flange portion, a circular projection projecting on a second, opposite side from a second face of the flange portion, a small diameter shaft portion formed integrally with the circular projection so as to project from an end face of the circular projection, and an engaging portion formed integrally with a leading end of the small diameter shaft portion, the engaging portion being formed in a plate member having first opposite sides which are shorter than a width of a narrow opening of the groove formed in the transom and second opposite sides having a length that is substantially equal to a width of an enlarged groove portion of the groove.

2. An arrangement for attaching a window board to a transom which comprises a generally horizontal transom having at least one groove formed in an inner end face thereof so as to open towards an indoor side of said transom; a horizontally extending cover attachment to which the window board is attached, the cover attachment extending in parallel to the transom; and a plurality of connecting members adapted to be engaged within said groove so as to fixedly secure the cover attachment to the inner end face of the transom wherein the transom has an inner longitudinal plate formed integrally therewith so as to project upwardly on the indoor side, and an an uprising piece formed integrally therwith so as to project upwardly and in parallel with the inner longitudinal plate at a position spaced inwardly away form the inner longitudinal plate, whereby a trough-shaped portion having an upward opening is formed between the uprising piece and the inner longitudinal plate.

3. An arrangement for attaching a window board to a generally horizontal transom comprising a transom having at least one groove formed in an inner end face thereof so as to open towards an indoor side of said transom; a horizontally extending cover attachment having a horizontal support piece formed integrally with a body thereof, the cover attachment having an indoor side and an outdoor side, said cover attachment being disposed on the inner side of and in parallel with the transom; a plurality of connecting members each being adapted to be attached to the cover attachment so as to project therethrough horizontally from the indoor side to the outdoor side of the cover attachment, each connecting member having an engaging portion formed integrally therewith and adapted to be engaged within the groove formed in the transom so as to fixedly secure the cover attachment by the interposition of a heat insulation material to the inner end face of the transom; and a window board having a receiving piece formed integrally therewith so as to be engaged with the horizontal support piece of the cover attachment, the window board being adapted to be supported by and connected to the cover attachment by engaging the receiving piece with the horizontal support piece of the cover attachment.

4. An arrangement as set forth in claim 3 wherein each of said connecting members has a flange portion, a knob portion projecting on a first side from a first end face of the flange portion, a circular projection projection on a second, opposite side from a second end face of the flange portion, a small diameter shaft portion formed integrally with the circular projection so as to project from an end face of the circular projection, and an engaging portion formed integrally with a leading end of the small diameter shaft portion, the engaging portion being formed in a plate member having first opposite sides which are shorter than a width of a narrow opening of the groove formed in the transom and second opposite sides having a length that is substantially equal to a width of an enlarged groove portion of the groove.

5. An arrangement as set forth in claim 3 wherein the transom has an inner longitudinal plate formed integrally therewith so as to project upwardly on the indoor side, and an uprising piece formed integrally therewith so as to project upwardly and in parallel with the inner longitudinal plate at a position spaced inwardly away from the inner longitudinal plate, whereby a trough-shaped portion having an upward opening is formed between the uprising piece and the inner longitudinal plate.

* * * * *